United States Patent [19]

Kurpan

[11] Patent Number: 4,693,592

[45] Date of Patent: Sep. 15, 1987

[54] PATCH GENERATOR FOR AN ELECTROPHOTOGRAPHIC DEVICE

[75] Inventor: Vincent E. Kurpan, Milford, N.H.

[73] Assignee: Eastman Kodak Company, Rochester, N.Y.

[21] Appl. No.: 867,166

[22] Filed: May 27, 1986

[51] Int. Cl.[4] ..... G03G 21/00

[52] U.S. Cl. ..... 355/14 E; 355/14 R

[58] Field of Search ..... 355/3 R, 14 R, 14 E, 355/14 D

[56] References Cited

U.S. PATENT DOCUMENTS

| | | | |
|---|---|---|---|
| 3,755,009 | 11/1973 | Collins | 355/83 |
| 4,082,445 | 4/1978 | Steiner | 355/14 |
| 4,239,372 | 12/1980 | Iwai | 355/14 R |
| 4,248,527 | 2/1981 | Akiyama et al. | 355/14 R |
| 4,277,549 | 7/1981 | Tatsumi et al. | 430/30 |
| 4,313,671 | 2/1982 | Kuru | 355/14 D |
| 4,378,153 | 3/1983 | Nishimura et al. | 355/3 R |

FOREIGN PATENT DOCUMENTS 857921 8/1981 U.S.S.R. .

OTHER PUBLICATIONS

Xerox Disclosure Journal, "IRD Patch Generation", Geir et al, vol. 6, No. 5, Sep./Oct. 1981, p. 247.

*Primary Examiner*—Fred L. Braun
*Attorney, Agent, or Firm*—Sales Milton S.

[57] ABSTRACT

A test patch generator for electrophotographic machines automatically adjusts test patch exposure to predetermined values regardless of operator-initiated changes in exposure settings. A main illumination source exposes an original document. Integrating the main illumination source produces an electrical signal representative of the amount of such exposure. The signal is modified by a factor selected in accordance with the exposure setting, and the modified signal is used to produce a latent image test patch on a photoconductor member, the patch having an exposure value corresponding to the modified signal. Once the patch is toned, a sensor can be used to measure the patch density and any necessary adjustments to the process parameters made.

6 Claims, 5 Drawing Figures

PATCH GENERATOR FOR AN ELECTROPHOTOGRAPHIC DEVICE

BACKGROUND OF THE INVENTION

1. Field of the Invention

This invention relates to the exposure of a charged photoconductor member to create latent image potential test patches useful in controlling process parameters in electrophotographic machines.

2. Description of the Prior Art

In electrophotographic machines such as printers and copiers, control of image density is required to produce copied images having constant and predeterminable image densities. Process parameters which determine image density include charger energization, exposure lamp illumination, development voltage bias, toner concentration in the developer mixture, and image transfer potential.

There are process parameter control methods known in the prior art wherein at least two test patches of different latent image potentials are formed on respective portions of a non-image area of the photoconductor member. The patches are developed, and the resulting toner densities of the patches are measured. The measured densities are used to adjust the image density parameters.

Generally, the test patches are created by exposing the photoconductor member to optical marks (one white and one black) on the frame portion of a platen on which original documents are laid. This provides two test patches of different densities which are useful to detect changes in sensitometric curves at widely spaced positions along the curve. Since one of the parameters which affects the patch density is exposure intensity, intentional changes in such intensity in response to operator-initiated changes in exposure settings to lighten or darken the copies will result in changes in patch densities. If the patch density measurement is used, without compensation for changes in exposure settings, the machine will attempt to adjust itself to return the measured patch densities to normal values. On the other hand, unintentional changes in exposure intensity needs to be detected and compensated for.

SUMMARY OF THE INVENTION

In accordance with the present invention, a test patch generator is provided for electrophotographic machines wherein test patch densities are automatically adjusted to predetermined values regardless of operator-initiated changes in exposure settings, and therefore are affected only by unintentional changes in exposure intensity.

A main exposure illumination source lights an original document to be copied. Light-integrating means exposed to the main exposure illumination produces an electrical signal representative of the amount of exposure. The signal is modified by a factor selected in accordance with the exposure setting, and the result is applied to means, responsive thereto, for producing a latent image test patch on a photoconductor member with an exposure value corresponding to the modified signal.

Once the patch is toned, a sensor can be used to measure the patch density and any necessary adjustments to the process parameters made. Since the test patch density is not a function of the exposure setting selected by the operator, adjustments to the process parameters will not be affected by that setting. For example, if the operator decides to darken copies, the copier logic will reduce the control voltage to the main exposure light source power supply. But by the present invention, the patches will be kept at a relatively constant density.

The invention, and its objects and advantages, will become more apparent in the detailed description of the preferred embodiment presented below.

BRIEF DESCRIPTION OF THE DRAWING

In the detailed description of the preferred embodiment of the invention presented below, reference is made to the accompanying drawings in which.

DETAILED DESCRIPTION OF THE PREFERRED EMBODIMENT

Figure 1:
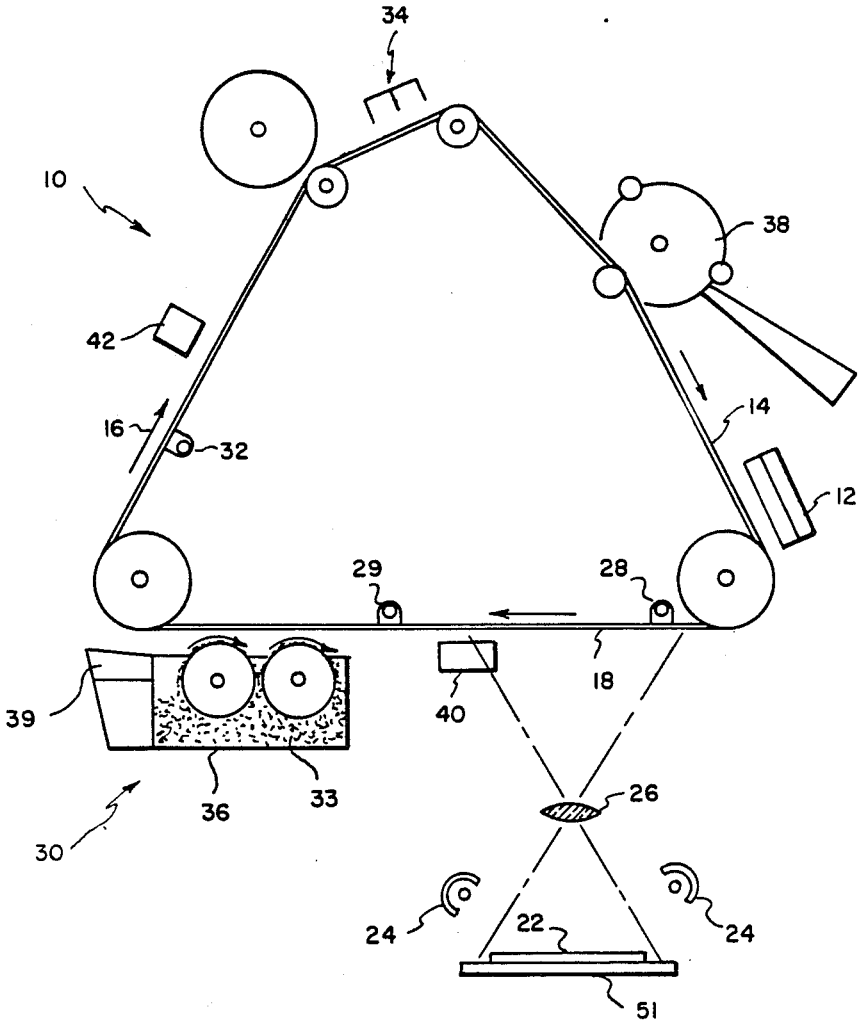
FIG. 1 is a schematic vertical section of an electrophotographic apparatus including a patch generator in accordance with the present invention.

To assist in understanding the present invention, an electrophotographic machine in which the invention may be used will be briefly described. It will be understood, however, that apparatus in accordance with the present invention can be used in other types of machines.

Referring now to the drawings in detail, an electrophotographic machine generally designated 10 includes a charging station 12 which is effective to apply a uniform charge on a transparent photoconductor member 14. The photoconductor member is an endless web trained about a plurality of rollers and driven in the direction indicated by an arrow 16. Photoconductor member 14 may comprise a layer of photoconductive material at, or adjacent to, the outwardly facing surface of the web, and a conductive backing or support layer on the back side of the web.

An information medium 22, referred to herein as an original document but which may be any form of image-bearing material, is illuminated by radiation from main exposure flash lamps 24. The radiation is reflected from the document and projected by a lens 26 onto the surface 18 of the photoconductor member. The radiation striking the charged photoconductor member selectively dissipates portions of the charge to form an electrostatic latent image on surface 18. The image areas on surface 18 are spaced slightly from each other along the length of the web to create interframe regions. The non-image areas may be selectively discharged by format erase lamp 28 and auxiliary erase lamp 29.

A magnetic brush development station 30 receives a supply of developer mixture 33 comprising, for example, toner particles and carrier particles. Magnetic development brushes carry toner particles to the latent image. Station 30 also includes a toner replenisher 39 which is adapted to furnish new toner to a reservoir 36 beneath the brushes.

The developed image then progresses past a development erase lamp 32 located at the back side of the photoconductor member to reduce photoconductor electrical fatique. At a transfer station 34, the toned image is transferred to a copy sheet fed from a paper supply, not shown. The image is fused to the copy sheet in any conventional manner. The photoconductor member is cleaned in a station 38, and is then available for another cycle of operation.

An electrophotographic machine as generally described hereinbefore is disclosed in more detail in commonly assigned U.S. Pat. No. 4,141,645, issued Feb. 27, 1979 to M. G. Reid et al. Reference is made to such patent for a more complete description of the machine and its operation.

An optical mark on the frame portion of platen 51 or on the flash housing is also illuminated by radiation from main exposure lamps 24. The radiation is reflected from the optical mark and projected by lens 26 onto a test patch generator 40. Generator 40, to be later described in detail, causes latent image test patches to be formed on a non-image area of photoconductor member 14. The test patches are developed to form optical test patches having densities corresponding to the main exposure. A photoelectric sensor 42 is provided to sense the optical density of the toner image of the optical mark. The optical density of the developed test patches, thereby providing a good reference for adjustment of the various process parameters of the copier.

The Test Patches

Figure 2:
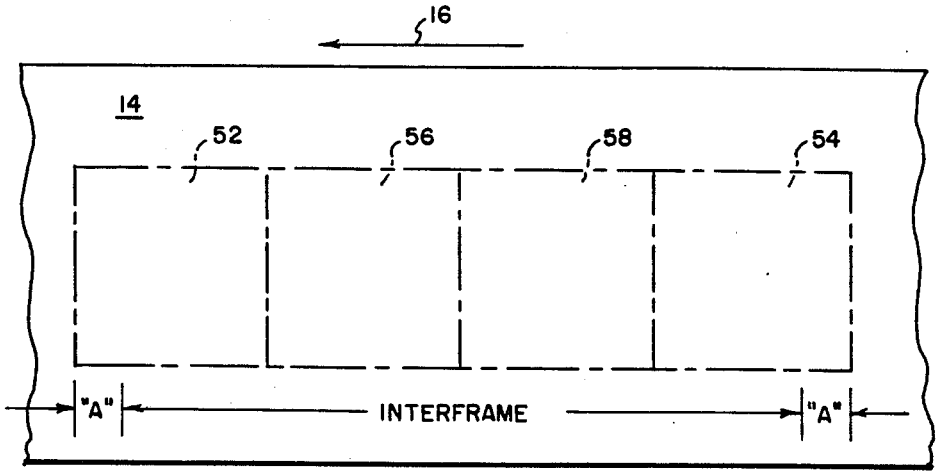
FIG. 2 shows the location of various test patches on a photoconductive member.

FIG. 2 illustrates the position of four test patches in the interframe region of the photoconductive member. For clarity, the size of the test patches is greatly exaggerated relative to the width of the photoconductive member. Two erase patches 52 and 54 are required to replace the functions of erase lamps 28 and 29, which have been masked in the cross-track position of the patches. The edges of the two erase patches preferably overlap the image area slightly (dimension "A" in FIG. 3) to prevent artifacts. Reference test patches 56 and 58 are used by machine process control apparatus to determine adjustments to the process parameters.

The Module

Figure 3:
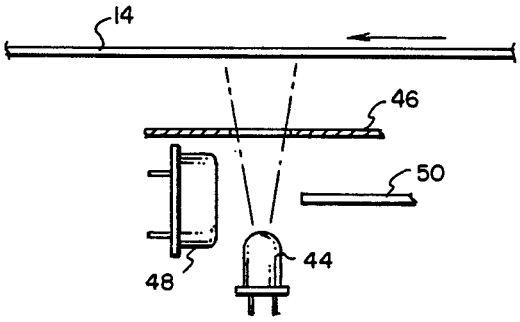
FIG. 3 is a side view of a portion of a test patch generating module which is part of the patch generator of the present invention.
Figure 4:
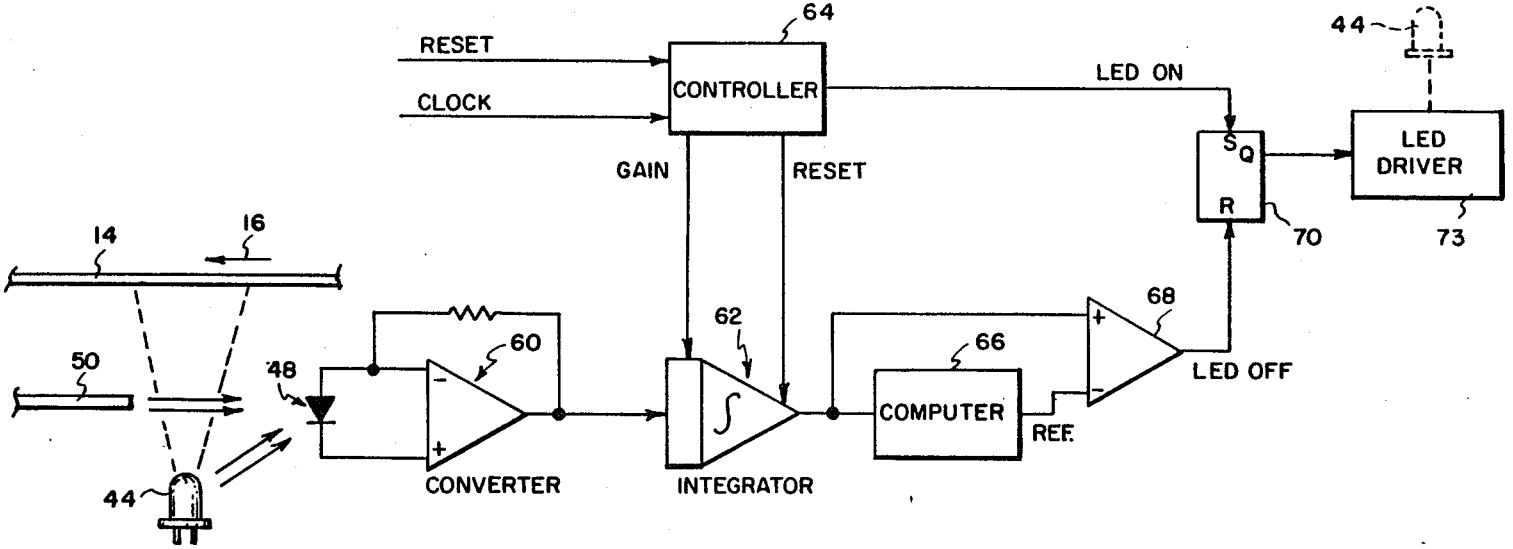
FIG. 4 is a schematic circuit diagram showing the patch generator of the present invention.

Reference is made to FIGS. 3 and 4. A light-emitting means such as a light-emitting diode (LED) 44 is positioned close to the surface of photoconductor member 14 so that when on, light from the LED passes through a mask 46 to expose a region of the photoconductor member. Light-sensing means such as a photodiode 48 is exposed to (or "sees") light from LED 44.

Photodiode 48 also sees light emitted from one end of an optical coupling 50 (e.g., light pipe, fiber optics, etc). The other end of optical coupling 50 is illuminated by light emitted by main exposure flash lamps 24 and reflected from the optical mark on the frame portion of platen 51 (FIG. 1). A mask (not shown) is provided to prevent erase, by lamps 28 and 29, of the charge in the cross-track portion of photoconductor member 14 corresponding to the opening in mask 46.

The Electronics

Figure 5:
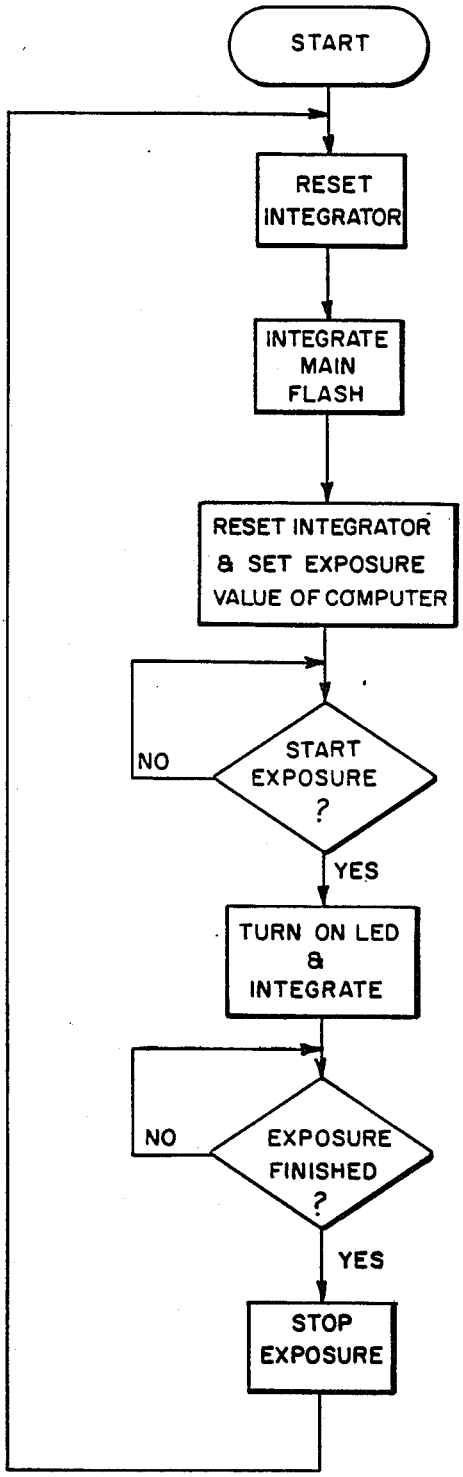
FIG. 5 is a flow diagram for the circuit of FIG. 4.

FIG. 4 is a schematic block diagram of apparatus for controlling LED 44 in accordance with an algorithm set forth in FIG. 5. Light energy from either LED 44 or optical coupling 50 falls on photodiode 48, and the current produced by the photodiode is proportional to the intensity of the incident light. The current is converted to a voltage by an operational amplifier 60 before processing by an integrator 62.

The output signal from integrator 62 is a measure of the amount of exposure photodiode to light (rather than of the intensity of the light). The integrator is capable of measuring exposure values for either main exposure flash lamps 24 or LED 44 because of the proximity of photodiode 48 to both light sources, noting that the photodiode is not exposed to both sources at the same time. This is an important factor in the system's ability to closely track the flash lamps, because any characteristic of the photodiode that affects one source affects the other. A controller 64 sets system timing, and also adjusts integration gain factors.

When an original document is illuminated and the corresponding electrical signal from photodiode 48 and amplifier 60 is integrated at 62, the integrated signal is applied to means for selectably modifying the signal such as a computer 66, which multiples the signal value by a selected gain to produce a reference signal. The reference signal is applied to the negative terminal of a comparator 68. This signal will be used as a stop point for the LED exposure during test patch generation. The multiplier factor used by computer 66 adjusts the patch exposure so that various patch exposure values can be effected, thereby simulating different grey scale densities.

Once the original document illumination is completed, and a reference signal has been generated by computer 66, integrator 62 is reset and LED 44 is turned on (both by controller 64) to begin a test patch exposure. A portion of the LED illumination falls on photodiode 48. Integrator 62, whose gain may be adjusted by controller 64 between document exposure and patch exposure, begins ramping up. The output of the integrator during patch exposure is applied to the positive terminal of comparator 68. When the integrated signal reaches the reference value from computer 66, the LED is shut off by a flip flop 70 controlling LED driver 73. This completes a test patch exposure.

The operation of the circuit of FIG. 4 is described in the flow diagram of FIG. 5. That diagram is believed to be self explanatory when viewed in conjunction with the above description of the circuit. In general, however, after the test patches are produced, they are toned and sensed by density sensor 42, the output thereof being used to control process parameters.

This invention has been described in detail with particular reference to a preferred embodiment thereof, but it will be understood that variations and modifications can be effected within the spirit and scope of the invention.

I claim:

1. A patch generator for creating a test patch on a charged photoconductor member useful in controlling process parameters in electrophotographic machines having a main illumination source for exposing an original document; said patch generator comprising:

means for producing an electrical signal having a value representative of the amount of exposure of the original document;

means for modifying said signal by a selectable factor; and means, responsive to said modified signal, for producing a test patch exposure on the photoconductive member, said test patch exposure having an exposure value determined by the value of said modified signal.

2. A patch generator as set forth in claim 1 wherein said signal-producing means includes light-integrating means, exposed to the main illumination source of the electrophotographic machine, for producing a signal with a value variable with the original document exposure.

3. A patch generator as set forth in claim 2 wherein said patch-producing means comprises light-emitting means to which the photoconductor member is exposed.

4. A patch generator as set forth in claim 3 wherein said light-integrating means is exposed also to said light-emitting means.

5. A patch generator as set forth in claim 3 wherein said patch-producing means comprises means for comparing the exposure of said light-integrating means by said light-emitting means to the exposure of said light-integrating means by the main illumination source, and for terminating exposure by said light-emitting means when the two are of a predetermined ratio.

6. A patch generator for creating a test patch on a charged photoconductor member useful in controlling process parameters in electrophotographic machines having (1) a main exposure illumination source for exposing an original document and (2) operator-initiated means for changing exposure settings; said patch generator comprising:

light-integrating means for producing an electrical signal having a value representative of the amount of original document exposure as controlled by the exposure setting;

means responsive to the operator-initiated exposure setting for modifying said signal by a compensating factor selectable in accordance with the exposure setting to produce a modified signal which is substantially unaffected by the exposure setting; and means, responsive to said modified signal for producing a test patch on the photoconductor member, said test patch having an exposure value determined by the value of said modified signal, whereby said patch exposure is substantially unaffected by the exposure setting.

* * * * *